US005169080A

United States Patent [19]

Bartkowiak

[11] Patent Number: 5,169,080

[45] Date of Patent: Dec. 8, 1992

[54] YARN WINDING APPARATUS AND METHOD

[75] Inventor: Klaus Bartkowiak, Herne, Fed. Rep. of Germany

[73] Assignee: Barmag AG, Remscheid, Fed. Rep. of Germany

[21] Appl. No.: 740,968

[22] Filed: Aug. 6, 1991

[30] Foreign Application Priority Data

Sep. 26, 1990 [DE] Fed. Rep. of Germany ..... 4030395
Nov. 22, 1990 [DE] Fed. Rep. of Germany ..... 4037124

[51] Int. Cl.[5] ..... B65H 54/02; B65H 54/71; B65H 54/553; B65H 75/28

[52] U.S. Cl. ..... 242/180 PW; 242/19; 242/129.51

[58] Field of Search ..... 242/18 PW, 18 DD, 129.51, 242/19

[56] References Cited

U.S. PATENT DOCUMENTS

| | | | |
|---|---|---|---|
| 3,162,388 | 12/1964 | Balash | 242/18 PW X |
| 3,198,445 | 8/1965 | Hull, Jr. et al. | 242/18 PW X |
| 3,251,560 | 5/1966 | Macedo | 242/18 PW X |
| 3,767,130 | 10/1973 | Perrino | 242/18 PW |
| 3,921,921 | 11/1975 | Katayama et al. | 242/18 PW X |
| 4,106,711 | 8/1978 | Oswald et al. | 242/18 PW X |
| 4,126,279 | 11/1978 | Munnekehoff . | |
| 4,205,800 | 6/1980 | Melan et al. . | |
| 4,561,600 | 12/1985 | Greive et al. | 242/18 PW X |
| 4,687,148 | 8/1987 | Schuller et al. | 242/18 PW |

FOREIGN PATENT DOCUMENTS

| | | |
|---|---|---|
| 2645220 | 11/1978 | Fed. Rep. of Germany . |
| 3516522 | 7/1989 | Fed. Rep. of Germany . |
| 54-43150 | 12/1979 | Japan . |
| 58-162464 | 12/1983 | Japan . |
| 61-267667 | 4/1987 | Japan . |

*Primary Examiner*—Stanley N. Gilreath
*Attorney, Agent, or Firm*—Bell, Seltzer, Park & Gibson

[57] ABSTRACT

A yarn winding apparatus and thread-up process are disclosed wherein a yarn bobbin is supported between rotatable clamping plates, and wherein at least one of the clamping places has an annular groove which defines a pair of laterally spaced rims. The rim which is adjacent the bobbin includes a yarn drop slot, a yarn catching slot having a forwardly directed nose, and a cutting blade is mounted in the groove behind the yarn catching slot. To effect thread-up, the advancing yarn is guided into the drop slot and thus into the groove, and it is then guided axially toward the bobbin so as to cause it to be looped about the nose of the yarn catching slot. The segment of the yarn remaining in the groove is then severed by the cutting blade.

12 Claims, 3 Drawing Sheets

YARN WINDING APPARATUS AND METHOD

BACKGROUND OF THE INVENTION

The present invention relates to yarn winding apparatus of the type wherein a tubular yarn bobbin is supported for rotation between two rotatable clamping plates. Yarn winding apparatus of this general type are disclosed for example in German Patent DE 35 16 522, U.S. Pat. No. 4,126,279, and copending U.S. application Ser. No. 07/565,814.

In winding apparatus of the described type, the problem of reliably threading the yarn to the new winding bobbin, and effecting a clean cut of the yarn length between the waste removal system and the winding bobbin continues to exist, in particular where doffing is conducted automatically. In the winding apparatus as disclosed in the referenced U.S. patent, the yarn is first guided over the yarn bobbin so as to partially loop the same, and it is then placed over the edge of the clamping plate with an axial component directed outwardly from the winding zone. In such known apparatus, it may occur that undesired long yarn ends project from the yarn reserve, which have different lengths from package to package, or depending on the quality of the yarn, attempts to thread the yarn may turn out to be unsuccessful. These attempts end up with a yarn break, with yarn remnants being found on the bobbin, between the bobbin and the clamping plate, and in the groove of the clamping plate. Attempts have been made to avoid yarn remnants between the bobbin and the centering plate, in that the inner rim of the centering plate extends inwardly far beyond the adjacent edge of the bobbin. However, a large projecting length can lead, in the case of automatic doffing, for example, with the use of so-called doffers, to problems with the removal of the full packages.

Accordingly, it is the object of the present invention to provide a yarn winding apparatus and method, having an improved thread-up capability, and which avoids the problems with the doffing of packages, which exist in the prior apparatus.

SUMMARY OF THE INVENTION

The above and other objects and advantages of the present invention are achieved in the embodiments disclosed herein by the provision of a yarn winding apparatus which includes a pair of clamping plates for supporting the rotating bobbin, and wherein at least one of the clamping plates comprises an annular body member having a radially directed groove about the outer circumference thereof and so as to define a pair of laterally spaced apart rims. A yarn drop slot is formed in one of the rims, and a yarn catching slot is formed in the one rim at a location circumferentially spaced from the drop slot. The yarn catching slot has one edge which is shaped to define a nose which extends in a predetermined circumferential direction, and a yarn cutting blade is mounted in the groove at a location circumferentially spaced from each of the slots, and such that the yarn drop slot, the yarn catching slot, and the yarn cutting blade are serially positioned with respect to each other in a circumferential direction opposite the predetermined circumferential direction.

According to the present invention, the yarn advancing from an auxiliary yarn guide, is first guided across the inner rim of the centering plate equipped with the above described yarn catching means, and while being continually removed by the action of a yarn suction device. As a result of the configuration of a yarn drop slot according to the present invention, it is accomplished that the yarn, without being first caught, drops through this slot into the groove and is guided in the same without being clamped. In so doing, the yarn is brought to a position favorable for catching and clamping. Its looping about the bobbin is thus eliminated or prevented right from the beginning.

The yarn length advancing to the yarn suction device remains in the intermediate groove. The yarn length advancing to the intermediate groove drops into the catching slot, and is guided to the outer side of the rim which faces the winding bobbin. It is then carried along in the direction of rotation and finally inserted into a clamping device, which is preferably formed at the inner end of the yarn catching slot. The yarn end advancing to the yarn suction device is then severed by the cutting blade in the groove.

As a result of the present invention, the yarn is fed to an accurately defined clamping zone in such a manner that the clamping zone and the yarn have the same direction of movement. Yarn remnants in the groove of the clamping plate or on the bobbin are avoided. Also, the yarn end has always the same short length.

The angular distance between the inlets of the catching slot and the drop slot is not critical for the operation of the apparatus of the present invention. However, when determining this angular distance, it is necessary to consider that the cutting blade must be positioned such that the yarn is held in the clamping device, before the yarn end advancing to the waste suction device comes into contact with the cutting blade. Suitable values for the angular distance range from about 60° to 120°, with the minimum spacing being about 50°.

The boundary edge of the catching slot, which is rearward in the direction of rotation, causes the yarn to adhere to it, and the yarn length advancing to the groove to be removed from the groove. Consequently, it is preferred that this boundary edge be formed as a nose extending in the direction of rotation, with its tip pointing toward the intermediate groove. A reliable catching is accomplished, when the nose extends laterally with its tip extending over a partial width of the intermediate groove. In a preferred embodiment, the catching nose comprises in its base the clamping device, which is preferably in the shape of a notch. Particularly preferred is an embodiment, in which the clamping device is a notch, which is formed between the flank of the catching nose and a chamfer of a ring, which is provided on the side of a cylindrical extension, and which is provided for engaging and supporting the bobbin. The notch serves to lock the yarn in position. Also, the ring is preferably formed of a suitable wear-resistant plastic, such as polyurethane.

In another embodiment, the plastic ring is seated against the outer face of the rim which contains the yarn drop slot and the yarn catching slot, and the ring forms the clamping notch with the axial end of the bobbin, in cooperation with the outer side of the catching nose. To this end and if necessary, the plastic ring can be provided with a chamfer on its outer periphery. Toward the end of the catching procedure, the yarn comes to lie in this catching notch and is held firmly enough so as to enable the winding of the yarn on the rotating bobbin even after the cutting of the yarn. The yarn length advancing to the waste suction nozzle, is separated by a cutting blade which is preferably mounted in the intermediate groove.

A further measure against an undesired, in particular premature, clamping of the yarn between the clamping plate and the front surface of the bobbin is a radially outwardly directed projection, which is provided in a further embodiment of the present invention on the centering extension or on the aforesaid polyurethane ring of the clamping plate equipped with the catching device, and which serves as a yarn deflector.

If only one of the clamping plates of the winding apparatus is provided with a yarn catching means, a selective arrangement on the one or the other side of the package holder may be desirable. In this event and even when yarn catching means are provided on both clamping plates of a package holder, it is preferable that the yarn catching slot and the yarn drop slot be arranged in mirror symmetry with respect to a plane bisecting their angular spacing and which includes the axis of rotation. Thus, depending on the arrangement of the clamping plate equipped with a yarn catching means, each of the slots can be a catching or a drop slot. Also, the clamping plate having a yarn catching means can be used irrespective of the intended direction of rotation.

For the sequence of the yarn catching procedure, it is important, especially with regard to the location of the cutting blade, that the yarn as it advances from the bobbin, drops with an outwardly directed component over the inner rim through the drop slot, and that is does not drop through the catching slot into the intermediate groove. Therefore, in an advantageous embodiment of the present invention, the catching slot is designed such that the catching nose of the slot extends on the side of the inner rim directed to the intermediate groove, past the opposite edge of the catching slot leaving a gap between the nose and the opposite edge. This will also apply to both slot noses in the case of the mirror-symmetric design of the slots.

BRIEF DESCRIPTION OF THE DRAWINGS

Some of the objects and advantages of the present invention having been stated, others will become apparent as the description proceeds when taken in conjunction with the accompanying drawings, in which.

DETAILED DESCRIPTION OF THE PREFERRED EMBODIMENTS

Figure 1:
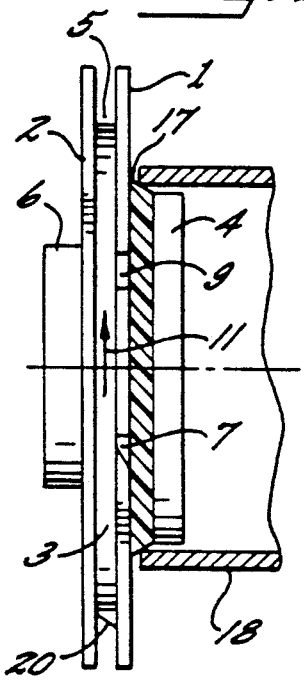
FIG. 1 is partly sectioned, side elevation view of a bobbin and clamping plate according to the present invention.

FIG. 1 illustrates, when viewed perpendicularly to the axis of rotation, a simplified top view of a yarn clamping plate with a yarn catching means 7, 9. FIG. 1 illustrates one clamping plate engaging one end of a tubular bobbin 18, and it will be understood that the bobbin 18 is supported between two rotatably mounted clamping plates for rotation about a central axis which extends coaxially through the bobbin, and as illustrated for example in U.S. Pat. No. 4,126,279.

Figure 7:
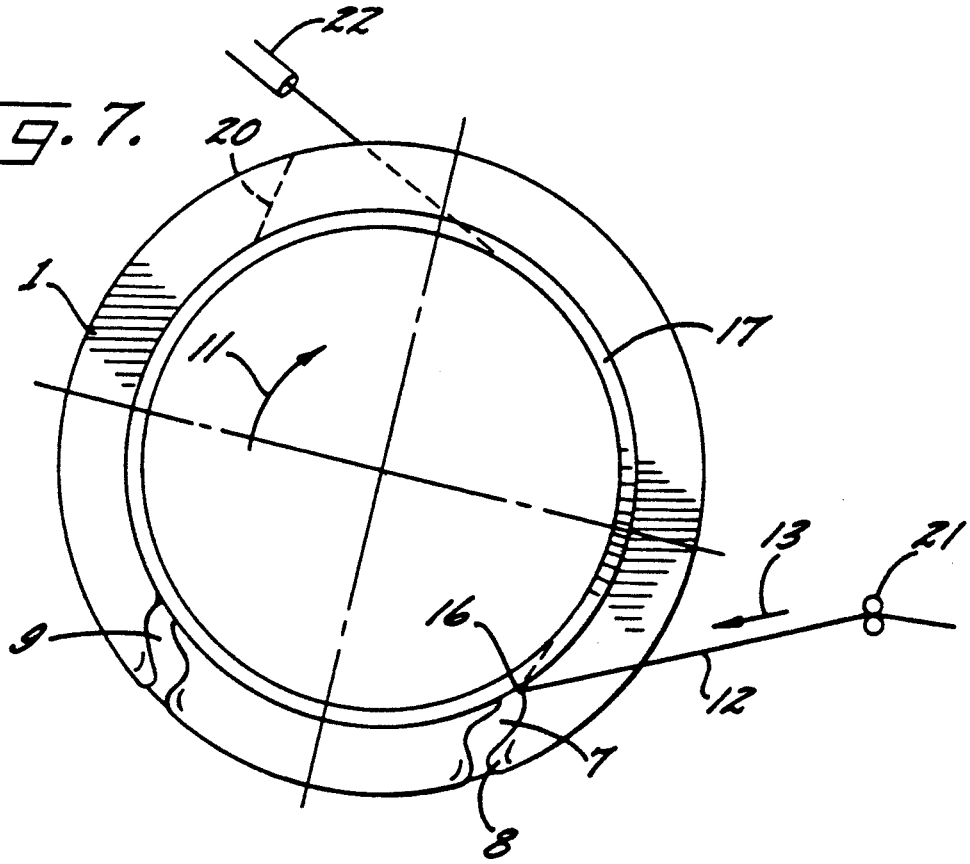

The clamping plate comprises an inner rim 1 which is adjacent the bobbin 18, an outer rim 2, and an intermediate zone 3 having a smaller diameter than the rims 1, 2. The intermediate zone 3 forms an intermediate groove 5. Provided on the inner rim 1 is a cylindrical extension 4, on which a tubular bobbin 18 is placed, and a plastic ring 17 is mounted on the extension 4 adjacent the inner rim 1. Arranged on the outer rim 2 is a brake ring 6. The inner rim 1 includes a drop slot 9, and a catching slot 7 which is circumferentially spaced therefrom in the direction of rotation 11. The drop slot 9 is relatively wide so as to facilitate the receipt of a yarn 12. Also, a blade 20 is positioned in the groove 5, as seen in FIGS. 1 and 7. The blade 20 is a razor like blade, the cutting edge of which is positioned angularly with respect to the axis of rotation of the clamping plate.

As best seen in FIG. 1, the plastic ring 17 has a chamfered outer periphery, and when the bobbin 18 is loaded on the chuck, the axial end of the bobbin engages the ring and forms a clamping notch between the outer face of the rim 1, the ring 17, and the axial end of the bobbin. Also, an indent 16 is formed at the base of the catching slot 7, note FIG. 2, to facilitate engagement of the yarn by the clamping notch.

Figure 2:
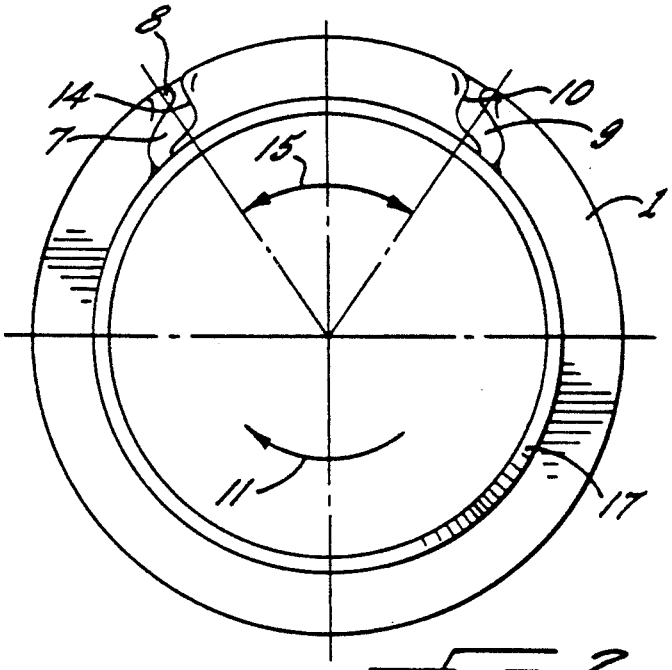
FIG. 2 is an end view of a first embodiment of the yarn catching means of the present invention.

FIG. 2 shows a clamping plate with a yarn catching means, in which the catching slot 7 and the drop slot 9 are designed symmetrically to a plane which bisects the angular distance 15 and which includes the axis of rotation. The slot located in front, when viewed in the direction of rotation 11, is the drop slot 9 having a radially extending drop edge 10, which is active during the threading of the yarn, and carries along the yarn 12. Advantageously, the rear boundary edge of the catching slot 7 is formed as a catching nose 8. The latter extends in a circumferential direction which corresponds to the direction of rotation 11, and the nose is preferably laterally inclined with its tip extending a portion of the distance across the width of the intermediate groove 5. This results on the on®hand in that when the yarn 12 advancing in the intermediate groove 5 is returned to the winding zone, its exit from the intermediate groove 5 is facilitated, and that furthermore the yarn 12 is prevented from accidentally dropping through the catching slot 7 into the groove 5. On the other hand, in the drop slot 9, which is formed in mirror symmetry thereto, the dropping of the yarn 12 is assisted by the nose-shaped tip extending toward the intermediate groove and forming the opposing boundary edge to the drop edge 10.

Figure 9:
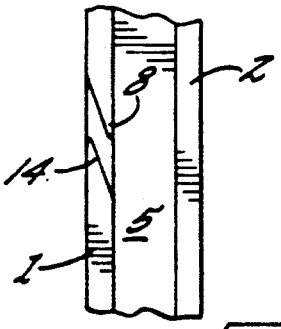
FIG. 9 is a fragmentary view perpendicular to the axis of rotation on the catching slot of FIG. 3.
Figure 3:
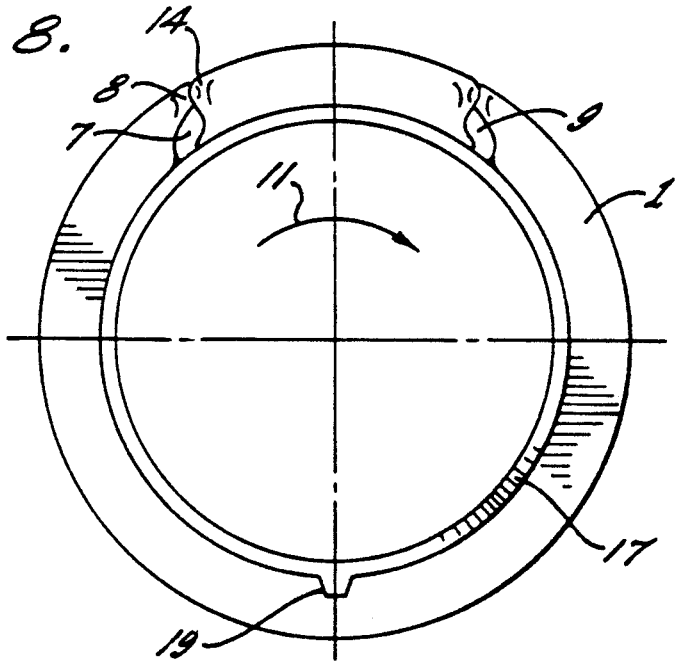
FIG. 3 is an end view of a second embodiment of the yarn catching means of the present invention.

The clamping plate of FIG. 3 differs from the previously described plate of FIG. 2, by the configuration of the catching slot 7 and the drop slot 9. Furthermore, it is provided with a deflecting extension 19. The shape of its catching slot 7 is shown in FIG. 9. The tip of the catching nose 8 is likewise directed, as in FIG. 2, toward the intermediate groove 5, and it can also here extend with its tip over a portion of the width of the intermediate groove 5. In addition, the boundary surface of the portion of opposite edge 14, which opposes the nose 8 and is directed to the outer periphery of the inner rim 1, extends approximately parallel to the catching nose 8. Thus, a passageway forms, which extends in the direction or rotation 11, obliquely from the outside to the inside, which does not impede the exiting of yarn 12 from the intermediate groove, but will make it difficult for the yarn to accidentally drop through the catching slot and into the groove 5. At the same time, the drop of the yarn 12 through the slot 9 into the groove 5 is facilitated as a result of its oppositely oriented configuration in comparison with the illustration in FIG. 9, in which the oblique extending slot 9 extends into the groove 5 against the direction of rotation 11.

The deflector extension 19 prevents in its area the yarn 12 from placing itself into the gap between the clamping plate and the bobbin 18 and from becoming clamped therein. This is accomplished in that a yarn 12, which dropped into the gap during a rotation of the bobbin, is again lifted out of the gap.

In the two foregoing embodiments, described with reference to FIGS. 2 and 3, the drop edge 10 extends substantially in the radial direction.

Figure 8:
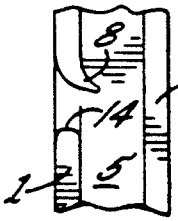
FIG. 8 is a fragmentary view perpendicular to the axis of rotation on the catching slot of FIG. 2.

Referring now to FIGS. 4–7, the sequence of the yarn thread-up procedure will be described with reference to the embodiment of the yarn catching means shown in FIGS. 2 and 8. Illustrated is a segment of the yarn length 12 between an auxiliary yarn guide 21 and a suction nozzle 22 serving to remove waste. The direction of the yarn path is indicated by arrow 13.

Figure 4:
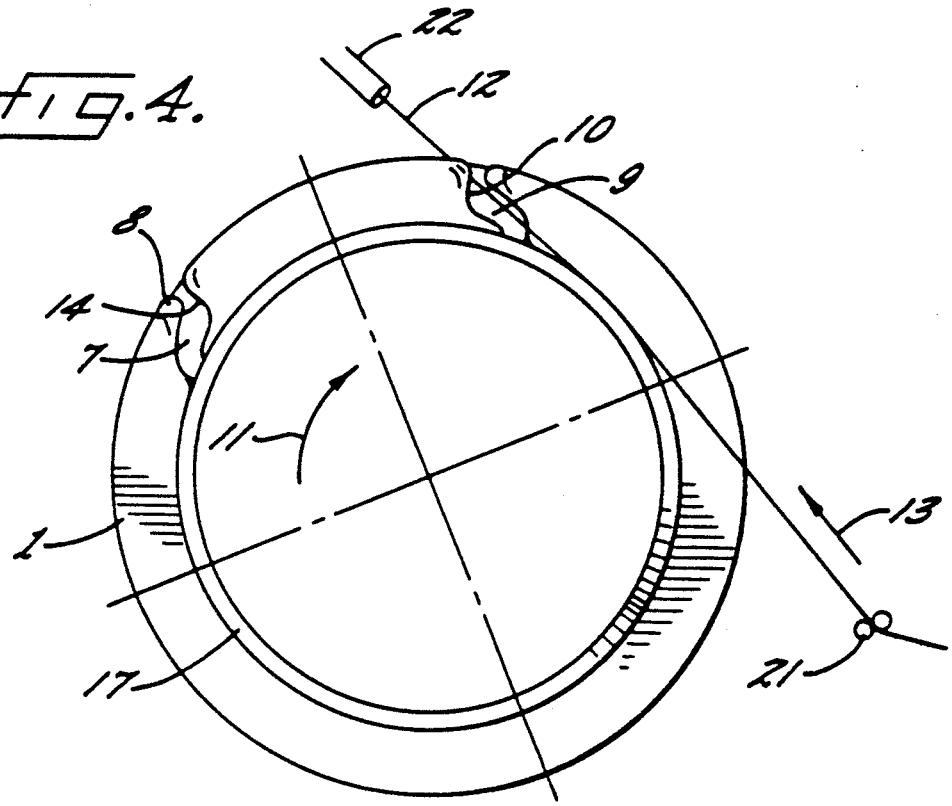
FIGS. 4–7 are end views illustrating the sequence of the yarn catching procedure.
Figure 5:
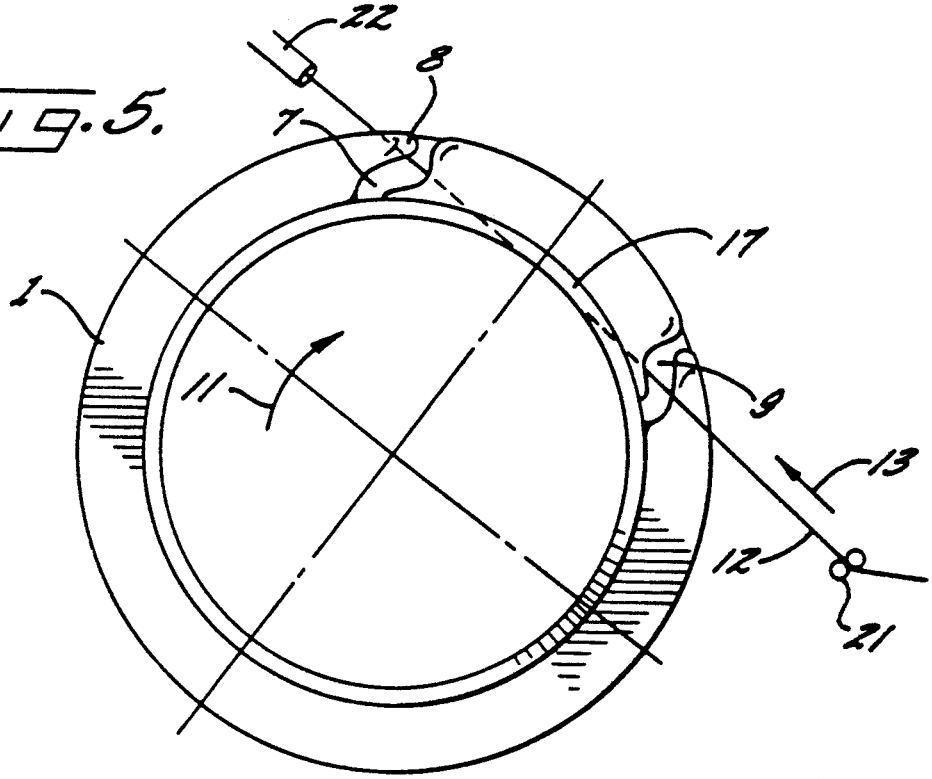
Figure 6:
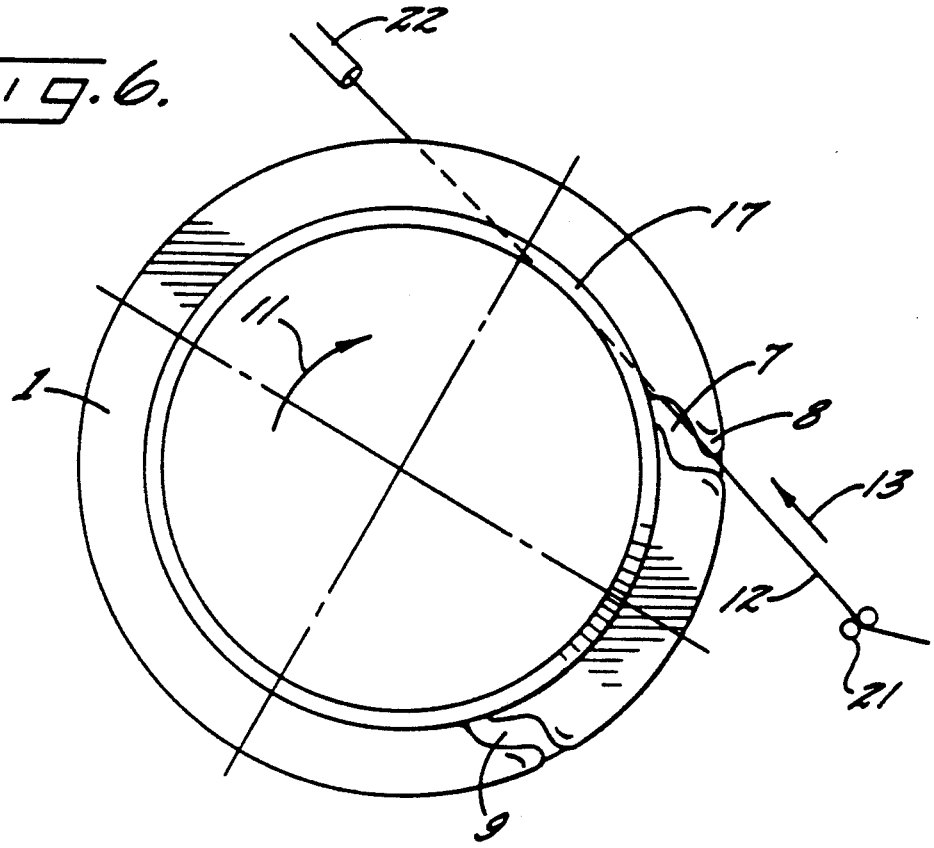

In FIG. 4, the yarn 12 advances from the auxiliary yarn guide 21 at the bottom right and is seized by a manually operated suction tube 22 and is moved axially of the bobbin 18 against the outer surface of the inner rim 1. Since the rim 1 is rotating, the yarn will be caught by the leading flank 10 (in the direction of rotation 11) of the drop slot 9 and move into the groove 5. Continued rotation of the clamping plate causes the leading edge or nose 8 of the catching slot 7 which protrudes into the intermediate groove 5 to move beneath the yarn 12 and cam it out of the slot 7, note FIG. 6. The clamping plate continues to rotate so that the yarn moves downwardly along the leading flank of the catching slot 7, and the yarn caught by the nose 8 loops around the nose, note FIGS. 6 and 7, and it eventually moves into the indent 16 and then into the clamping notch formed between the ring 17 and the axial end of the bobbin 18. That part of the yarn 12 which is seized by the suction tube 22 will, however, remain in alignment with the intermediate groove 5 and will eventually be cut by engagement with the blade 20 which is positioned within the groove 5. Thus even after the continued rotation and cutting by the blade 20 of the yarn end advancing to the waste nozzle, the additionally fed yarn 12 is securely held and wound on the bobbin.

In the drawings and specification, there has been set forth preferred embodiments of the invention, and although specific terms are employed, they are used in a generic and descriptive sense only and not for purposes of limitation.

That which is claimed is:

1. A clamping plate adapted for supporting one end of a tubular yarn bobbin during a yarn winding operation, and having provision for catching and severing the yarn during the yarn thread-up procedure, and comprising an annular body member having a radially directed groove about the outer circumference thereof and so as to define a pair of laterally spaced apart rims, a yarn drop slot formed in one of said rims, a yarn catching slot formed in said one rim at a location circumferentially spaced from said drop slot, and having one edge which is shaped to define a nose which extends in a predetermined circumferential direction, and a yarn cutting blade mounted in said groove at a location circumferentially spaced from each of said slots, and such that said yarn drop slot, said yarn catching slot, and said yarn cutting blade are serially positioned with respect to each other in a circumferential direction opposite said predetermined circumferential direction.

2. The clamping plate as defined in claim 1 further comprising a yarn clamping notch formed at the inner end of said one edge of said yarn catching slot.

3. The clamping plate as defined in claim 2 further comprising an annular ring positioned on the outer side of said one rim, and wherein said yarn clamping notch is formed between said outer side of said one rim and said ring.

4. The clamping plate as defined in claim 3 further comprising a cylindrical extension coaxially mounted to said outer side of said one rim for coaxially supporting a yarn bobbin, and wherein said annular ring is coaxially mounted upon said cylindrical extension.

5. The clamping plate as defined in claim 3 wherein said annular ring includes a radial projection for deflecting the yarn from the gap between the end of the bobbin tube and the outer side of said one rim.

6. The clamping plate as defined in claim 1 wherein said nose extends laterally across a portion of the width of said groove.

7. The clamping plate as defined in claim 1 wherein said yarn catching slot has a second edge which is opposite said one edge and which extends in a generally radial direction.

8. The clamping plate as defined in claim 7 wherein said annular body member defines a central axis of rotation, and wherein said yarn drop slot and said yarn catching slot are configured to be in mirror symmetry with respect to the plane which bisects the angular distance therebetween and which includes said central axis of rotation.

9. The clamping plate as defined in claim 7 wherein a portion of said nose extends circumferentially beyond said second edge.

10. A method of threading a yarn onto a tubular bobbin which is supported between two rotatable clamping plates for rotation about a central axis which extends coaxially through the bobbin, and wherein at least one of the clamping plates comprising (a) an annular body member having a radially directed groove about the outer circumference thereof and so as to define a pair of laterally spaced apart rims, with one of said rims being positioned adjacent said bobbin, (b) a yarn drop slot formed in said open of said rims, (c) a yarn catching slot formed in said one rim at a location circumferentially spaced from said drop slot, and having one edge which is shaped to define a nose which extends in a predetermined circumferential direction, and (d) a yarn cutting blade mounted in said groove at a location circumferentially spaced form each of said slots, and such that said yarn drop slot, said yarn catching slot, and said yarn cutting blade are serially positioned with respect to each other in a circumferential direction opposite said predetermined circumferential direction, and comprising the steps of rotating the bobbin and the supporting clamping plates about said central axis and in said predetermined circumferential direction, guiding an advancing yarn across said one rim in an oblique direction which extends generally opposite to the rotational direction and from said bobbin toward said groove, dropping said advancing yarn through said drop slot and into said groove, guiding said advancing yarn along the groove, engaging the advancing yarn in the groove with said nose of said yarn catching slot, moving the advancing yarn to the outer side of said one rim which is adjacent the bobbin, looping the advancing yarn about said nose to define a yarn segment in said groove and a yarn segment outside the groove, and engaging the yarn segment in said groove with said yarn cutting blade to sever the yarn segment.

11. The method as defined in claim 10 wherein the step of looping the advancing yarn about said nose includes clampingly engaging the yarn at the base of said yarn catching slot.

12. The method as defined in claim 11 comprising the further subsequent step of winding the advancing yarn onto the rotating bobbin.

* * * * *

UNITED STATES PATENT AND TRADEMARK OFFICE

CERTIFICATE OF CORRECTION

PATENT NO. : 5,169,080

DATED : December 8, 1992

INVENTOR(S) : Klaus Bartkowiak

It is certified that error appears in the above-identified patent and that said Letters Patent is hereby corrected as shown below:

Column 4, line 41, "on ®hand" should be -- one hand --.

Column 6, line 46, "comprising" should be -- comprises --.

Column 6, line 52, "open" should be -- one --.

Column 6, line 59, "form" should be -- from --.

Signed and Sealed this

Twelfth Day of October, 1993

*Attest:*

*Attesting Officer*

BRUCE LEHMAN

*Commissioner of Patents and Trademarks*